US008356712B2

(12) United States Patent
Piazza, Jr.

(10) Patent No.: US 8,356,712 B2
(45) Date of Patent: Jan. 22, 2013

(54) PORTABLE CONTAINER WITH INTEGRATED TABLE SURFACE

(76) Inventor: Joseph A. Piazza, Jr., Highland Heights, OH (US)

( * ) Notice: Subject to any disclaimer, the term of this patent is extended or adjusted under 35 U.S.C. 154(b) by 0 days.

(21) Appl. No.: 13/134,753

(22) Filed: Jun. 16, 2011

(65) Prior Publication Data

US 2012/0318177 A1 Dec. 20, 2012

(51) Int. Cl.
*B65D 43/00* (2006.01)

(52) U.S. Cl. ..... 206/545; 190/12 R; 108/14; 220/592.02

(58) Field of Classification Search ..... 206/541, 206/545; 220/592.2, 259, 592, 592.01, 592.02, 220/256.1, 259.1; 190/11, 12 A, 12 R; 312/241; 108/14

See application file for complete search history.

(56) References Cited

U.S. PATENT DOCUMENTS

| | | | | |
|---|---|---|---|---|
| 592,159 | A | | 10/1897 | Miller |
| 2,895,311 | A | | 7/1959 | Spalvins |
| 4,581,902 | A | | 4/1986 | Starck et al. |
| D299,796 | S | | 2/1989 | White |
| 5,480,170 | A | | 1/1996 | Kaiser, II |
| D368,387 | S | | 4/1996 | Bureau |
| 5,551,558 | A | * | 9/1996 | Bureau ..... 206/223 |
| D376,068 | S | | 12/1996 | Coy |
| 5,730,282 | A | * | 3/1998 | Bureau ..... 206/223 |
| D403,899 | S | | 1/1999 | Paparo, Jr. |
| 5,860,281 | A | | 1/1999 | Coffee et al. |
| 5,876,047 | A | | 3/1999 | Dennis |
| 5,947,032 | A | | 9/1999 | Meiser |
| 6,311,991 | B1 | | 11/2001 | Conrado et al. |
| 6,328,179 | B1 | | 12/2001 | Conrado et al. |
| 6,796,319 | B1 | | 9/2004 | Patarra et al. |
| 7,011,364 | B2 | | 3/2006 | Meskill et al. |
| 7,334,802 | B2 | | 2/2008 | Kaplan |
| 7,451,709 | B2 | | 11/2008 | Swartfager et al. |
| 7,909,148 | B1 | * | 3/2011 | Miller et al. ..... 190/11 |

* cited by examiner

*Primary Examiner* — Jacob K Ackun

(74) *Attorney, Agent, or Firm* — Hudak, Shunk & Farine Co. LPA

(57) ABSTRACT

A portable, insulated container, preferably a cooler, including an integrated table surface upon which items can be placed. The table surface is movable between a stowed position and an extended position, wherein each position the lid of the container can be lifted to access the interior cavity of the container. Advantageously, the footprint of the table surface in a horizontal plane is always located above the footprint of the container in a horizontal plane such that object or item in a surrounding area need not be disturbed in order to move the table surface between the stowed position and the extended position.

17 Claims, 6 Drawing Sheets

PORTABLE CONTAINER WITH INTEGRATED TABLE SURFACE

FIELD OF THE INVENTION

The present invention relates to a portable, insulated container, preferably a cooler, including an integrated table surface upon which items can be placed. The table surface is movable between a stowed position and an extended position, wherein each position the lid of the container can be lifted to access the interior cavity of the container. Advantageously, the footprint of the table surface in a horizontal plane is always located above the footprint of the container in a horizontal plane such that objects or items in a surrounding, adjacent area need not be disturbed in order to move the table surface between the stowed position and the extended position.

BACKGROUND OF THE INVENTION

Portable insulated containers such as coolers, ice chests and ice boxes are commonly used to maintain food and beverages at desired temperatures at various locations, for example sporting events, picnics, fishing trips, a beach or swimming pool, and camping trips; especially where conventional cooling or heating access is not available.

Containers have been proposed having many different features for example wheels, handles, and tray surfaces designed to make use and transportation of the containers easier for the user. Examples of various containers include U.S. Pat. Nos. 7,011,364; 5,876,047; Des. 368,387; U.S. Pat. Nos. 5,480,170; 5,947,032; 5,860,281; Des. 403,899; Des. 299,796; U.S. Pat. No. 6,796,319 and Des. 376,068.

U.S. Pat. No. 4,581,902 relates to a portable cooler and auxiliary table. The cooler includes an insulated container having an openable top to provide access to the cooler chamber. In one embodiment, an auxiliary top panel is provided with U-shaped brackets at opposite ends which are selectively securable in receivers at the opposite ends of the container to secure the top in a position immediately overlying the cooler cover for storage. To place the auxiliary table in an elevated position of use, the table is removed from the receivers and legs are foldable from a stored position to a position of use and engageable in the receivers to position the table at an elevation above and parallel to the cooler top to allow access to the cooler chamber. The table may also be removed for use independent of the cooler. In other embodiments, the legs are extendible from apertures in the cooler side or end walls to allow the table unit to be elevated to the desired position and then secured in place. In another embodiment, the support legs are pivotally secured to the end of the cooler between the storage position and a position of use. In the latter embodiment, the auxiliary table is selectively securable to the cooler top in the stored position so that access is provided to the cooler chamber in the storage position. Additional storage for food utensils and other items reportedly may be provided in drawers or recesses provided in the auxiliary table.

U.S. Pat. Nos. 6,311,991 and 6,328,179 relate to a portable cooler that includes a cooler body provided with wheels and a pivoted towing handle provided with two grips to allow use of the cooler by persons of both tall and short stature. The cooler cover is provided with a recess and a closure panel for storage of items within the cooler but above melting ice or relatively heavy items that might crush items contained in the cooler. A table assembly is operable independently of the lid allowing the table to be deployed on a leg with the cooler lid in a closed position, as well as to allow access to the interior cavity of the cooler without clearing the table. Retractable bungee cords for securing items to the cooler are provided.

U.S. Pat. No. 7,334,802 relates to a portable, insulated container with lid; particularly a portable insulated container with lid and attached tray for movement between a stowed and elevated position above the surface of the container lid reportedly capable of supporting various items thereon while simultaneously allowing the user to lift the lid of the container to access the interior; more particularly to a portable cooler with an attached retractable tray constructed and arranged to be positioned by a single user at various elevations above the surface of the lid.

U.S. Pat. No. 7,451,709 relates to a portable cooler and table assembly that reportedly may be transported in a single, self-contained unit. The assembly may be converted for use as a table for a variety of recreational activities, e.g., dining, drinking, games such as ping pong, beer pong, table hockey, card games, board games, preparation for sporting events and meals. The table and cooler may be permanently attached to each other, or alternatively, the cooler may be detachable from the table. The table may fold or collapse to assist in converting the assembly from a transportable unit into a fully extended and operable table and cooler. The table surface may contain surface features such as grooves, indentations, nets, game pieces, etc. The cooler may comprise any container that is capable of containing ice or some other refrigeration or heating system, e.g., a conventional 54 quart beverage cooler. Alternatively, the cooler may be replaced with a storage container or other storage device. The assembly may also contain various wheels, legs and handles to assist in mobility and conversion.

In view of the prior art, a problem exists inasmuch as containers are often arranged in an areas of limited space, such as between or adjacent other objects, for example chairs, walls, vehicles or plants. In the case of a container having a detachable table surface it is possible that the same can be lost, thus making the container less useful. Regardless of whether the container has a removable table surface, the table surface may also have a footprint not located above that of the container during positioning of the table surface on the container.

SUMMARY OF THE INVENTION

In view of the above, it is an object of the present invention to provide a portable insulated container having an internal storage area or cavity adapted to hold goods and a table assembly with a table surface that can be moved from a stowed position to an extended position, with the table surface having a footprint maintained above, and preferably substantially parallel or parallel to the footprint of the container during said movement.

Yet another object is to provide the insulated container with a table surface located above a lid, wherein in a stowed position, a table lid of the table surface is pivotable along with a container base lid in order to access the internal storage area or cavity of the container.

Still a further object is to provide an insulated container having a table surface vertically adjustable using a height adjusting assembly, while maintaining the table surface in a horizontal plane between the stowed position and the extended position.

A further object of the present invention is to provide an insulated container having a table surface adjustable by hand and without the need for tools by a single user utilizing an actuating mechanism.

An additional object of the present invention is to provide a container having a table surface adjustable from a stowed position to an extended position without having to disturb or move objects next to or adjacent the container.

Yet another object of the present invention is to provide an insulated container having a durable, strong tray surface that is movable from a stowed position to an elevated position above the container.

In one aspect, a portable container with an integrated table surface is disclosed comprising a container comprising a base having an internal cavity adapted for receiving items to be maintained in a desired temperature range, the container including a lid operatively connected to the base and upwardly pivotable thereon, the base having a footprint in a horizontal plane; and a table assembly connected to the container body and having a table surface with a table lid upwardly pivotable thereon, the table surface movable between a stowed position and an extended position, wherein the table surface has a footprint in a horizontal plane, and wherein the table surface footprint is located above the base footprint during movement between the stowed position to the extended position.

In a further aspect portable container with an integrated table surface is disclosed, comprising a container comprising a base having an internal cavity adapted for receiving items to be maintained in a desired temperature range, the container including a lid operatively connected to the base and upwardly pivotable thereon; and a table assembly including a pair of mount plates connected to the container base, a table leg operatively connected to and substantially vertically adjustable in relation to each mount plate, a table surface connected to an arm of each table leg, the table surface including a table lid upwardly pivotable in relation to the container base, wherein the table surface in a stowed position is located in a substantially horizontal plane adjacent and parallel to the container lid and in an extended position is located in a substantially horizontal plane directly above the lid.

Yet another aspect is a portable container with an integrated table surface is disclosed, comprising a container comprising a base having a front side wall and a rear side wall connected at each end by end walls, said walls defining an interior cavity, and a lid hingedly located on the base for accessing the interior cavity; a mount member connected to each end wall and having a guide surface extending in a substantially vertical direction; a table leg slidably connected to each mount plate, each table leg including an arm to which a table surface is connected; the table legs including a height adjusting assembly for moving the table surface between a stowed position adjacent to the base lid and an extended position located a distance above the base lid thereby allowing the base lid to be pivoted such that the interior cavity can be accessed.

These and other objects and advantages of the present invention will be more apparent from the accompanying description taken in conjunction with the accompanying drawings wherein, various embodiments of the invention are set forth.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
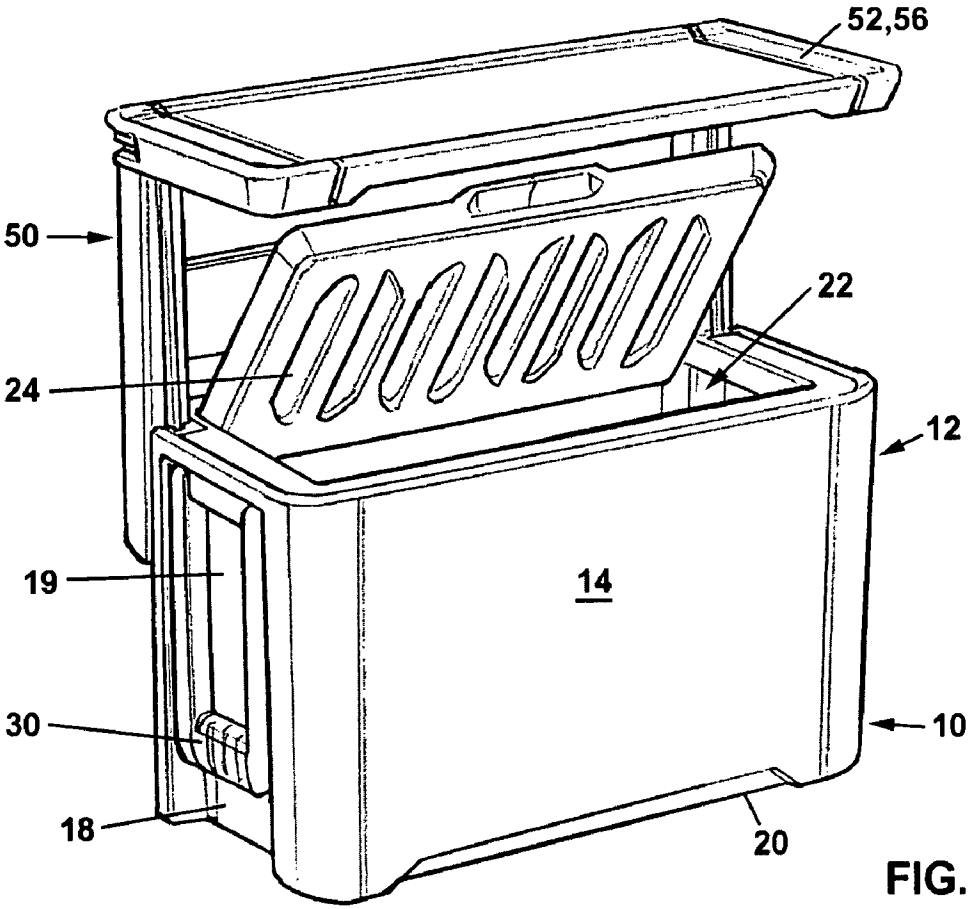
FIG. 1 is a front left perspective view of one embodiment of a portable, insulated container having an integrated table assembly having a table surface, wherein the lid of the container base is shown in an open position and the table surface is in an extended position.
Figure 2:
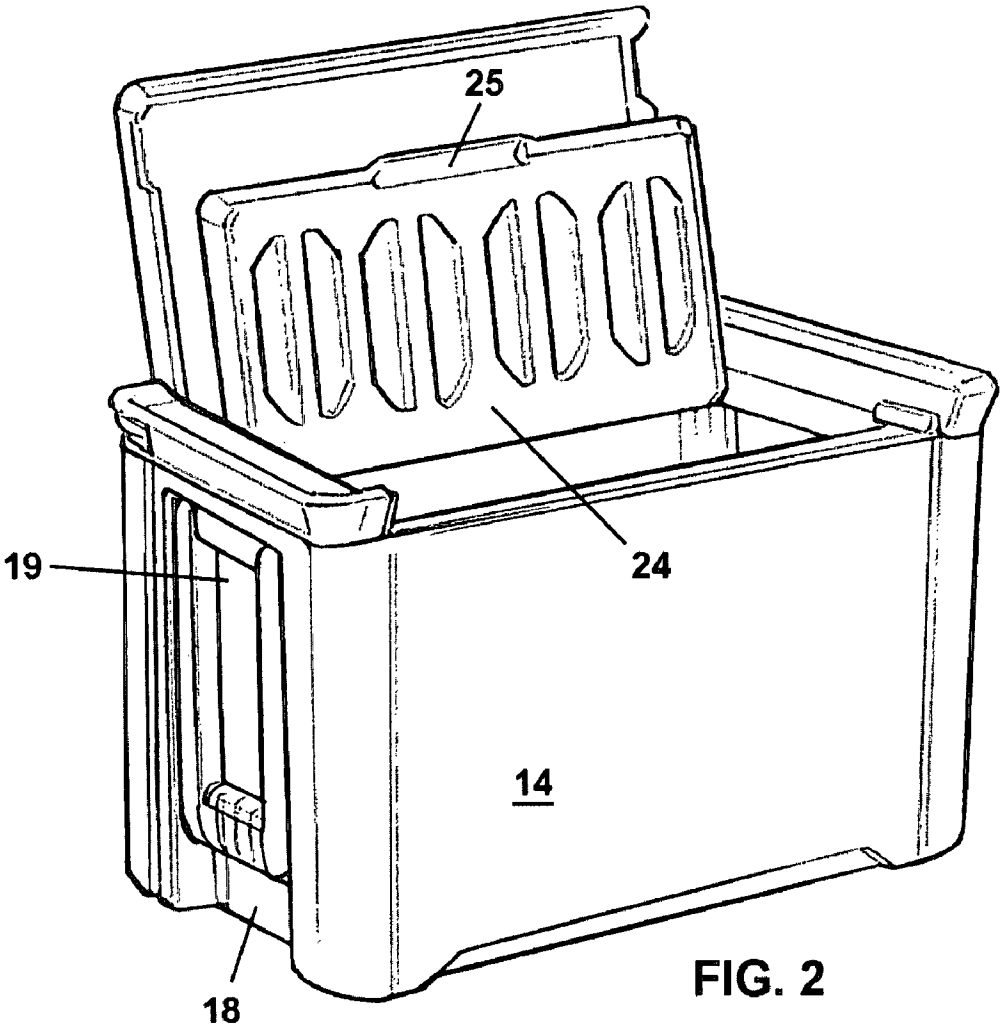
FIG. 2 is a front left perspective view of the portable, insulated container, wherein the table surface is in a stowed position and a central table lid portion thereof along with the lid of the container base are in an open position such that the internal cavity of the container can be accessed.

This description of useful embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring now to the drawings, FIG. 1 illustrates a front left perspective view of one embodiment of a portable, insulated container 10 including an integrated table assembly 50 including a table surface 52. The table surface can be moved between an extended position illustrated in FIG. 1 and a retracted or stowed position illustrated in FIG. 3, during which time the table surface remains in a substantially horizontal plane and substantially parallel to the upper surface of the base which includes a lid 24, and thus above a footprint of the container. The table surface 52 generally moves in a vertical direction while substantially maintaining a horizontal plane.

While the container 10 is illustrated in rectangular form, it is to be understood that the same can have other forms, e.g. square, rounded etc. The container has a base 12 having a front side wall 14 and rear side wall 16; and end walls 18 that connect the side walls 14, 16. In a useful embodiment as shown in the drawings, each wall is connected to a bottom 20 of the base 12 thereby defining an interior cavity 22 that can be accessed at least through container base lid 24. In a useful embodiment, the base 12 is a single piece, such as formed by molding, e.g. rotational molding.

The interior cavity 22 can have generally any form. In a useful embodiment, the cavity 22 can be configured to receive items such as food, beverages, ice, cold packs, etc. and can include one or more of compartments, dividers and secondary containers, or the like to provide for a desired structure within the cavity 22. If desired, the base can include a spigot 28, see FIG. 4, in order to drain liquid from the cavity 22.

Figure 4:
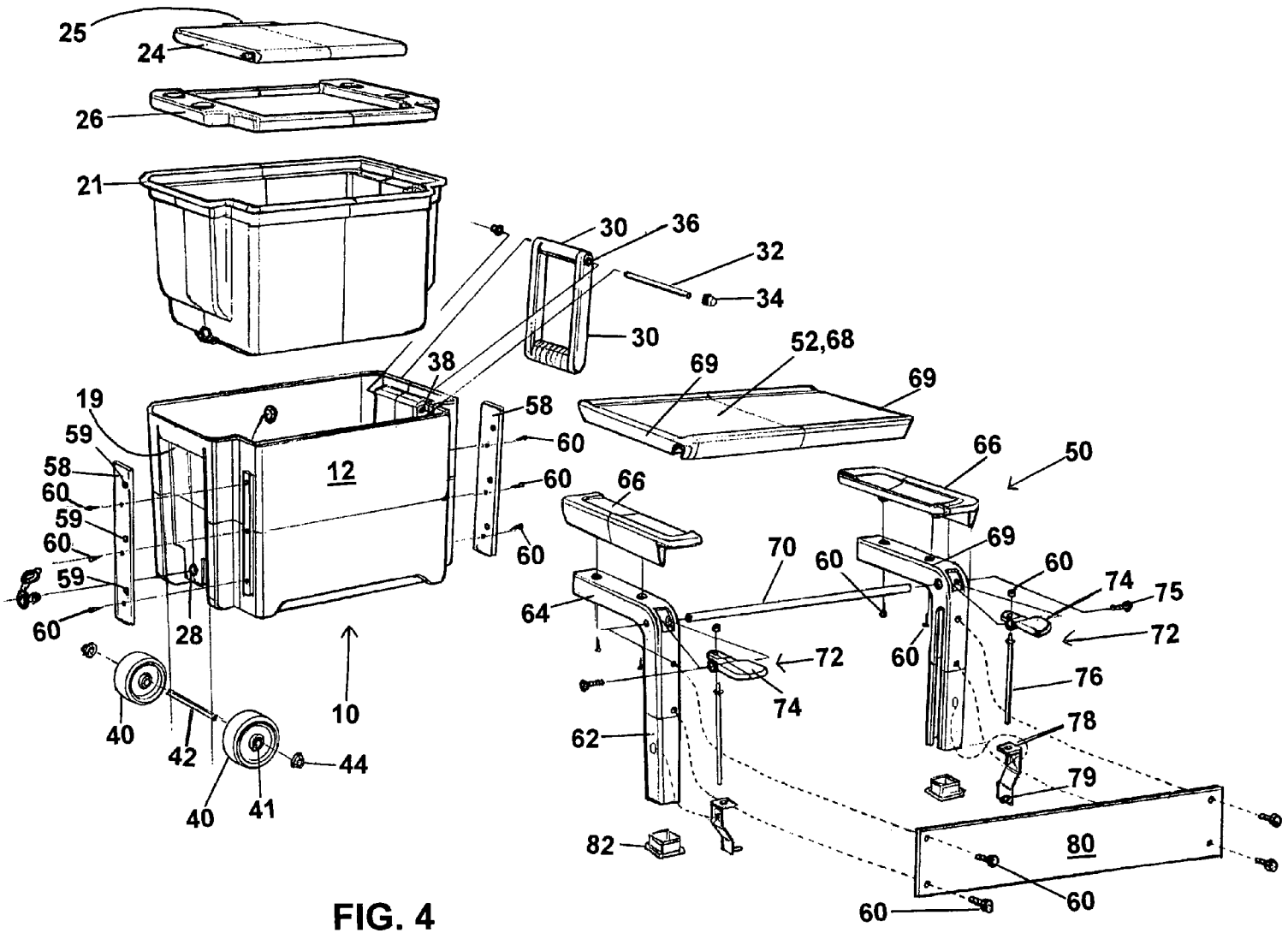
FIG. 4 is a right rear exploded view of an embodiment of the portable insulated container of the present invention illustrating various components thereof.

As illustrated in FIG. 4, the container 10 also includes a top 26 that is connected to the base 12 in any suitable manner such as one or more of an adhesive and fastener. In a useful embodiment as shown, the base 12 includes a rim having a seat upon which the top 26 sits. A lid 24 is mounted, preferably hingedly or pivotally in one embodiment, to the top 26, by any suitable attachment such as hinges, pins and recesses, an axle or any functionally equivalent structure. The lid 24 in a useful embodiment includes a handle 25 that can be utilized to lift or close the lid to provide desired access to the interior cavity 22. The handle 25 or lid 24 can include a locking mechanism to provide selective access to the interior cavity 22.

The container 10 includes at least one transportation handle 30 pivotally connected to one of the walls of the base 12, such as end wall 18 as shown in the drawings. FIG. 4 particularly illustrates an axle 32 that is extendable through an orifice 36 in the handle 30 and an end wall orifice 38 and securable with an end cap or nut 34 at each end. Other pivotal connectors as known in the art can be used in other embodiments, for example, hinges, pins and recesses. The handle 30 can be rotated generally between a storage position as shown with the handle located in recess 19 against end wall 18 and a towing position that allows a user to pull or move the container using wheels 40. Wheels 40 are mounted for rotation using axle 42 extending through wheel orifice 41 and an orifice in the base 12, the axle secured to the container 10 with wheel end caps or nuts 44. The wheels 40 are connected to the container, i.e. such that upon lifting handle 30 and the end of the container connected thereto, the wheels 40 become the only part of the container 10 in contact with the ground, thereby allowing the container 10 to be rolled to another location.

Figure 3:
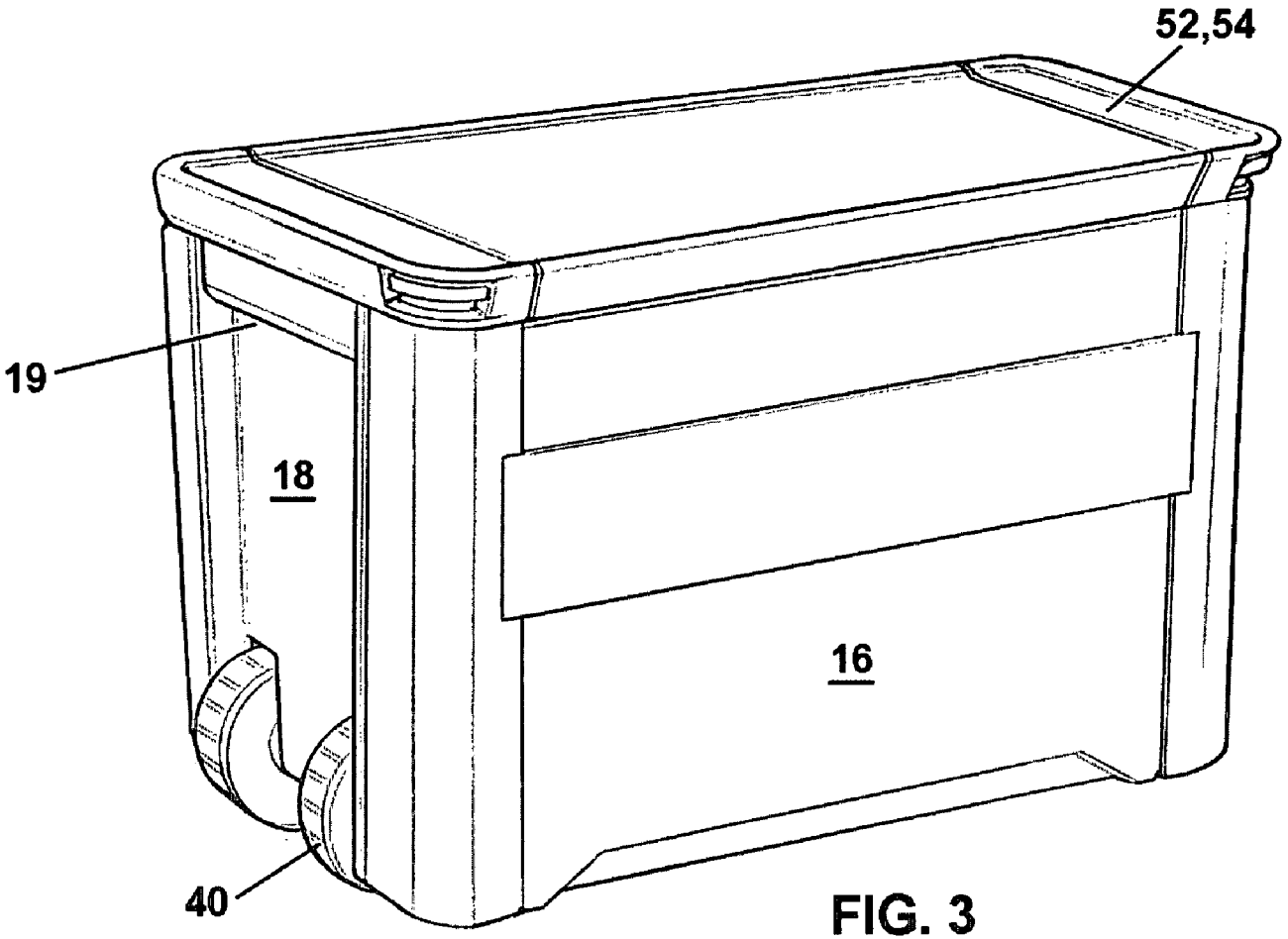
FIG. 3 is a right rear view of an embodiment of the portable, insulated container illustrating the table surface in a stowed position on top of the container, wherein actuating levers of the height adjusting assembly are visible.

The table surface 52 is movable between a stowed position 54 and an extended position 56, for example as shown in FIGS. 3 and 1 respectively. Importantly, the table surface 52 can be maintained in a horizontal plane during movement between said positions. This feature advantageously allows the user to be able to leave items on the table surface while the height thereof is changed and moved between said positions.

As illustrated in FIG. 1, the container lid 24 can be opened to access interior cavity 22 with the table surface 52 in the extended position 56 without contacting table surface 52 or having to move any objects thereon. Even when the table surface 52 is in a stowed position such as shown in FIG. 3, the interior cavity 22 can be accessed by first lifting table lid 68 of table surface 52 and subsequently lid 24.

Figure 6:
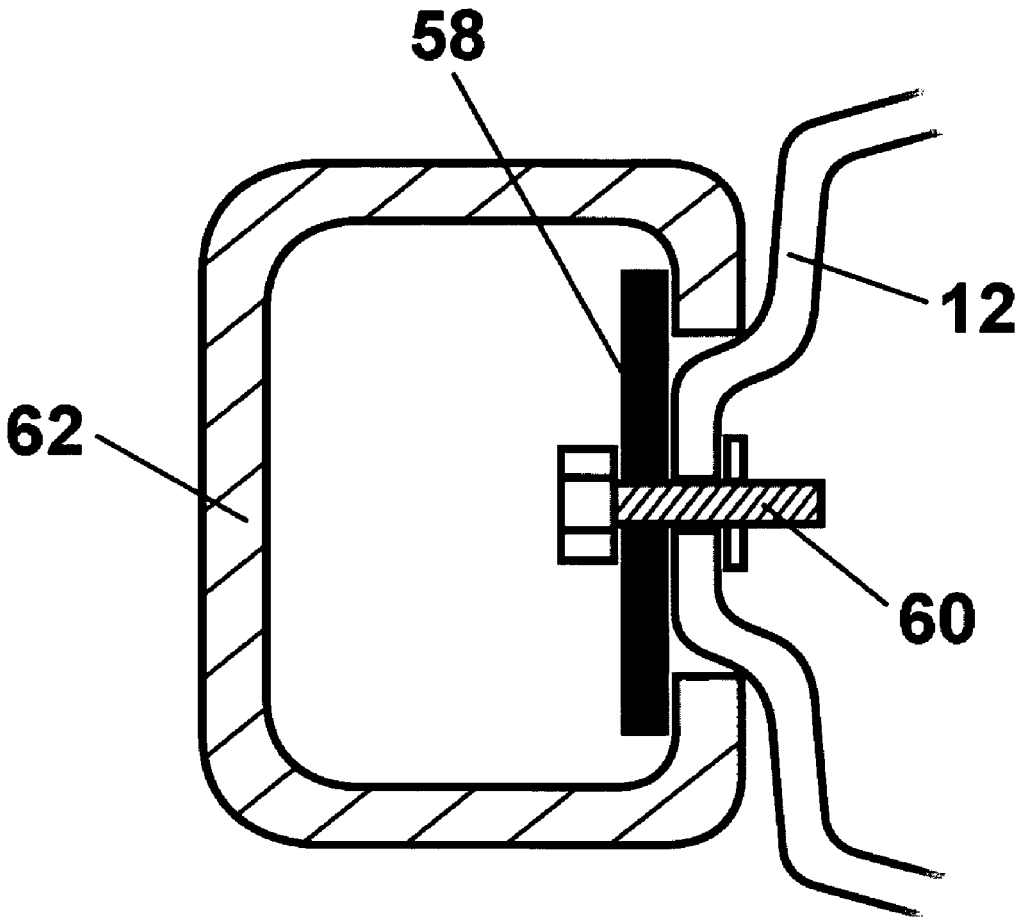
FIG. 6 is a cross-sectional view through a portion of one embodiment of the table assembly particularly illustrating the slidable attachment of a table leg in relation to the base through the use of a mount plate and a fastener.

The table assembly 50 includes a mount member, preferably an arm or plate 58 connected to and extending a substantially vertical distance along each end wall 18 by one or more fasteners 60. A table leg 62 is adjustably connected in relation to each mount plate 58. The distance range of the table surface from the stowed position to the extended position is sufficient to allow lid 24 to be opened and closed freely when the table assembly 52 is in either the stowed position 54 or extended position 56. The range of motion depends on factors such as the dimensions of the base and the table surface and desired clearance between the base lid and the table surface in the extended position. As illustrated in FIG. 6, the table leg 62 includes a channel or hollow portion in which the mount plate 58 can be situated such that the table leg is slidably or otherwise movable in relation to, generally in a vertical direction, the container base 12. During the assembly of the container 10, the table leg 62 is mated with the mount plate 58 by sliding the table leg 62 over and around the mount plate 58. In one embodiment, as illustrated, the table leg has a substantially C-shaped segment including a channel that allows the table leg 62 to be mated with the mount plate 58. As described herein, the height adjusting assembly 72 provides for a fixed connection of the table leg 62 and thus the table assembly 50 at a plurality of different positions, e.g. two, three, four or more positions with respect to mount plate 58 through height adjustment apertures 59 as further described herein.

The table surface 52 includes end leaves 66 connected to an arm 64 of table leg 62. The table lid 68 is connected between leaves 66 to table leg 62 by pivot rod 70. The rod 70 extends through and is connected to a portion of each table leg 62. Table lid 68 in a down or horizontal position has ends 69 which lie adjacent the end leaves 66, and in one embodiment rests on an upper surface of arm 64 and maintains the table lid 68 in a horizontal position.

A height adjusting assembly 72 present on table assembly 52 moves the table surface 52 between the stowed position 54 and extended position 56, and optionally different positions therebetween. The height assembly includes an actuating lever 74 hingedly connected to a portion of table leg 62 through a pivot assembly bolt 75. A push rod 76 is connected to actuating lever 74 at one end and operatively to a spring release 78 at the other end. The spring release 78 is connected to the table assembly 50, in particular the table leg 62 and includes a projection or tab 79 mateable with a height adjustment aperture 59 of the mount plate 58. Spring release 78 in an unactuated position biases the tab 79 towards the mount plate 58 such that when the tab encounters a height adjustment aperture 59, the tab 79 engages, mates with, or otherwise extends through the height adjustment aperture 59 thereby locking the table assembly in relation to the container base 12. As a plurality of height adjustment apertures 59 are present, the table assembly 50 can be locked at a plurality of different positions including at least the stowed position 54 and extended position 56.

Figure 5A:
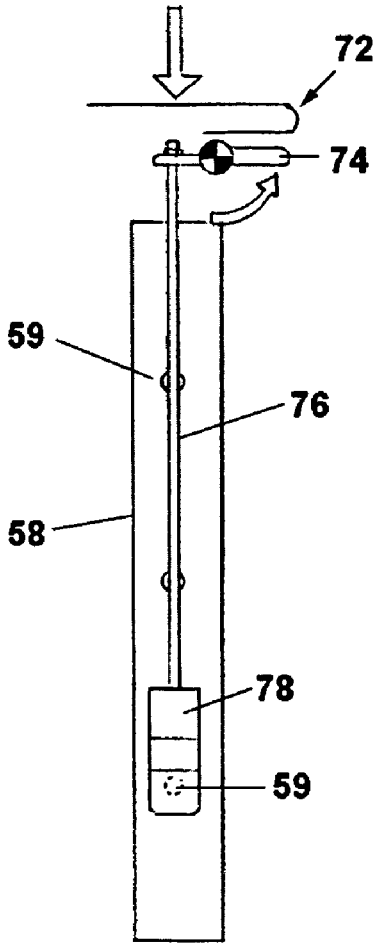
FIG. 5A is a partial side view of one embodiment of the table assembly particularly illustrating a height adjusting assembly including an actuating lever whereby the table surface can be situated at a plurality of different vertical heights in relation to the container base.
Figure 5B:
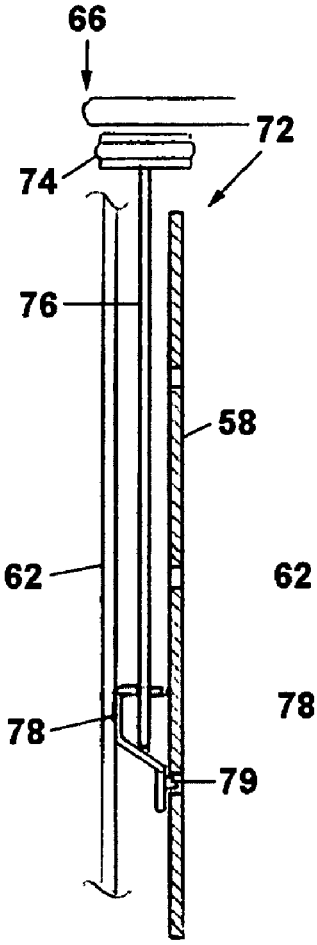
FIG. 5B is a partial view illustrating a portion of a height adjusting assembly fixing the table assembly to the container base through the connection of a tab of the height adjusting assembly to a height adjustment aperture of a mount plate.
Figure 5C:
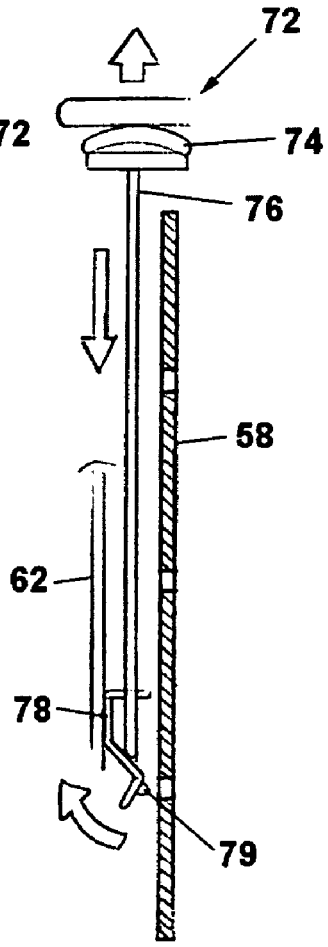
FIG. 5C is a view similar to FIG. 5B showing the height adjusting assembly in an actuated position thus allowing for movement of the table assembly in relation to the container base with the tab removed from the height adjusting aperture.

The height adjusting assembly 72 is actuated by operating actuating lever 74 on each table leg 62 whereby the push rod 76 disconnects or disengages tab 79 of the spring release 78 from the height adjustment aperture 59. With the tab 79 disengaged from the height adjustment aperture 59, see FIG. 5C for example, the table assembly 50 is adjusted vertically to a desired position, such as the stowed position 54 or extended position 56. When the actuating levers 74 are released by the user, the tabs 79 return to their biased positions and are thereby allowed to mate with a suitable height adjustment aperture 59, see FIGS. 5A and 5B for example.

In order to provide design strength and support to table legs 62, a table leg support 80 is connected between the table legs 62, utilizing suitable fasteners 60. The table assembly 50 also includes end cap plugs 82 situated in the base of table leg 62.

The container 10 in a useful embodiment includes a liner 21 such as shown in FIG. 4. The liner 21 can include insulating materials and/or insulating material as known to those of ordinary skill in the art can be included between the base 12 and liner 21. Likewise, the base lid 24 can be fabricated to include insulating materials if desired.

In one embodiment, a polymer foam can be utilized as insulating material.

In view of the above, the portable container with integrated table surface provides numerous advantages for a user. In addition to providing a container having an internal cavity for receipt of items whose temperature can be maintained at a predetermined level, the container is provided with a table assembly that includes a table surface adapted to support items while allowing access to the interior cavity of the container. In a stowed position, the table surface resides compactly on top of the container lid. The table surface includes a table lid that can be pivoted along with the container lid to allow access to the interior cavity of the container.

By providing the container with a table assembly having a table surface that can be maintained in a horizontal plane between the stowed position and the extended position, access to the interior cavity of the cooler body by opening the base lid without clearing the table surface can be achieved, and items or other objects adjacent the container need not be disturbed in order to utilize the container.

As indicated hereinabove, the table surface of the table assembly has an areal footprint that is maintained within the areal footprint of the base even as the table surface is moved from a stowed position to the extended position.

In accordance with the patent statutes, the best mode and preferred embodiment have been set forth, the scope of the invention is not limited thereto, but rather by the scope of the attached claims.

What is claimed is:

1. A portable container with an integrated table surface, comprising:

a container comprising a base having an internal cavity adapted for receiving items to be maintained in a desired temperature range, the container including a lid operatively connected to the base and upwardly pivotable thereon, the base having a footprint in a horizontal plane; and a table assembly connected to the container base and having a table surface with a table lid upwardly pivotable thereon, the table surface movable between a stowed position and an extended position, wherein the table surface has a footprint in a horizontal plane, and wherein the table surface footprint is located above the base footprint during movement between the stowed position to the extended position, wherein the table assembly includes two table legs each fixedly connected to a different table arm, that fixedly extends outward from the table leg and wherein the table surface is connected to the table arms such that the table lid is pivotable in relation to the fixed position table arms in the stowed position.

2. The portable container according to claim 1, wherein the table leg is substantially vertically adjustable in relation to the container base.

3. The portable container according to claim 2, wherein the table leg includes a channel that is slideably mated in relation to a mount member that is connected to and extends a substantially vertical distance along a wall of the container.

4. The portable container according to claim 3, wherein the mount member includes a plurality of height adjustment apertures, wherein the table assembly includes a height adjusting assembly comprising a projection selectively mateable with the height adjustment apertures to fix the height of the table assembly in relation to the container base.

5. The portable container according to claim 4, wherein the height adjusting assembly includes an actuating lever operatively connected to a pushrod that operatively actuates the projection to engage and disengage the projection from the height adjustment apertures.

6. The portable container according to claim 5, wherein the projection is connected to a spring release that is actuated by the pushrod, wherein the pushrod and the spring release are located in the table leg channel, and wherein the mount member is in the form of a plate having vertically separated height, adjustment apertures.

7. The portable container according to claim 6, wherein the table assembly comprises the two table legs connected by a table leg support, wherein the table lid is hingedly connected to the table assembly between two end leaves each connected to one of the table arms, and wherein the base lid is hingedly connected to the base.

8. The portable container according to claim 1, wherein the base lid can be opened without contacting the table surface when the table assembly is in the extended position.

9. A portable container with an integrated table surface, comprising:

a container comprising a base having an internal cavity adapted for receiving items to be maintained in a desired temperature range, the container including a lid operatively connected to the base and upwardly pivotable thereon; and a table assembly including a pair of mount plates connected to the container base, a table leg operatively connected to and substantially vertically adjustable and upwardly extendable in relation to each mount plate, wherein each table leg includes a channel that is slidably mated in relation to the mount plate, wherein each mount plate includes a plurality of height adjustment apertures, wherein the table assembly includes a height adjusting assembly comprising a projection selectively mateable with the mount plate height adjustment apertures to fix the height of the table assembly in relation to the container base, a table surface connected to an arm of each table leg, the table surface including a table lid upwardly pivotable in relation to the container base and between the arms of table leg, whether the table surface is in a stowed position or extended position, wherein the table surface with the table lid down in the stowed position is located in a substantially horizontal plane adjacent and parallel to the container lid and in the extended position is located in a substantially horizontal plane directly above the lid.

10. The portable container according to claim 9, wherein the height adjusting assembly includes an actuating lever operatively connected to a pushrod that operatively actuates the projection to engage and disengage the projection from the height adjustment apertures.

11. The portable container according to claim 10, wherein the projection is connected to a spring release that is actuated by the pushrod, wherein the pushrod and spring release are located in the table leg channel, and wherein the height adjustment apertures are vertically separated.

12. The portable container according to claim 11, wherein the base lid can be opened without contacting the table surface when the table assembly is in the extended position.

13. A portable container with an integrated table surface, comprising:

a container comprising a base having a front side wall and a rear side wall connected at each end by end walls, said walls defining an interior cavity, and a lid hingedly located on the base for accessing the interior cavity;

a mount member connected to each end wall and having a guide surface extending in a substantially vertical direction;

a table leg slidably connected to each mount member, each table leg including an arm to which a table surface is connected;

the table legs including a height adjusting assembly for moving the table surface between a stowed position parallel and adjacent to the base lid and an extended position located a distance above the base lid thereby allowing the base lid to be pivoted such that the interior cavity can be accessed, wherein the height adjusting assembly of the table legs includes an actuating lever operatively connected to a pushrod that operatively actuates a projection to engage and disengage the projection from the mount member.

14. The portable container according to claim 13, wherein the table leg includes a channel that is slideably mated in relation to the mount member that is connected to and extends a substantially vertical distance along a wall of the container.

15. The portable container according to claim 14, wherein the mount member includes a plurality of height adjustment apertures, wherein the height adjusting assembly projection is selectively mateable with the height adjustment apertures to fix the height of the table assembly in relation to the container base.

16. The portable container according to claim 15, wherein the projection is connected to a spring release that is actuated by the pushrod, wherein pushrod and spring release are located in the table leg channel, and wherein the mount member is in the form of a plate having vertically separated height adjustment apertures wherein the table assembly comprises two table legs connected by a table leg support wherein the table lid is hingedly connected to the table assembly between two end leaves, and wherein the base lid is hingedly connected to the base.

17. The portable container according to claim 13, wherein the base lid can be opened without contacting the table surface when the table assembly is in the extended position.

* * * * *